United States Patent [19]

Sovis, Jr. et al.

[11] Patent Number: 4,817,240

[45] Date of Patent: Apr. 4, 1989

[54] APPLIANCE DOOR HINGE

[75] Inventors: Milo D. Sovis, Jr., Grand Haven; James A. Parker, Holland, both of Mich.

[73] Assignee: Ace Manufacturing Co., Grand Haven, Mich.

[21] Appl. No.: 501,006

[22] Filed: Jun. 3, 1983

[51] Int. Cl.[4] ..... E05F 1/08

[52] U.S. Cl. ..... 16/297; 16/298; 16/306; 16/322; 16/344; 126/194

[58] Field of Search ..... 16/322, 344, DIG. 39, 16/286, 292, 297, 298, 304, 322, 331, 332, 334, 341, 344, 374; 126/194

[56] References Cited

U.S. PATENT DOCUMENTS

| | | | |
|---|---|---|---|
| 772,119 | 10/1904 | Ahlvin . | |
| 1,652,008 | 12/1927 | Gercich et al. . | |
| 2,579,091 | 12/1951 | Rinaldo | 16/322 |
| 2,721,547 | 10/1955 | Pollock | 16/332 |
| 2,780,219 | 2/1957 | Pollock . | |
| 2,800,128 | 7/1957 | Chesser . | |
| 3,250,267 | 5/1966 | Fry | 126/194 |
| 3,437,087 | 4/1969 | Price | 126/194 |
| 3,450,125 | 6/1969 | Hopkins | 126/194 |
| 3,453,996 | 7/1969 | Agee | 126/194 |
| 3,698,781 | 10/1972 | Dunn . | |
| 3,842,542 | 10/1974 | White et al. | 126/194 |

*Primary Examiner*—Frank T. Yost
*Assistant Examiner*—James L. Wolfe
*Attorney, Agent, or Firm*—Varnum, Riddering, Schmidt & Howlett

[57] ABSTRACT

A hinge for a range door and the like having a frame bracket (18) adapted to be mounted to a range housing, a hinge arm (40) adapted to be mounted to a range door and pivotably mounted to the frame bracket (18) and a cam follower arm (16) pivotably mounted to the frame bracket (18). A cam follower element (76) on the cam arm (60) is biased by a tension spring (80) against a cam surface on a cam arm portion (46) of the hinge arm to counterbalance the weight of the range door. The cam surface has indentations (50, 52) which define equilibrium positions of the door for an ajar and fully open position. A tab stop (34) is struck out from the frame bracket (18) to stop the pivotable movement of the cam follower arm (60) as the hinge arm (40) reaches the fully open position (FIG. 5). The cam follower arm (60) has a number of indentations (64) for receiving one end (84) of the spring (80) to adjust the counter-balancing force on the oven door.

15 Claims, 3 Drawing Sheets

APPLIANCE DOOR HINGE

FIELD OF THE INVENTION

This invention relates to hinges. In one of its aspects, the invention relates to hinges for range doors in which the weight of the door is counterbalanced and equilibrium positions of the door in an ajar and open position are provided.

STATE OF THE PRIOR ART

Range door hinges pivotably mount range doors on a frame and further provide the functions of counterbalancing the door, provide equilibrium position of the door in ajar and fully open positions and bias the door in a closed position from an ajar equilibrium position. Examples of hinge constructions which function in this manner are disclosed in the U.S. Pat. Nos. 2,780,219 to Pollock (issued Feb. 5, 1957) and Chesser 2,800,128 (issued Jul does not provide an ajar equilibrium but otherwise provides a counterbalancing function is disclosed in the U.S. Pat. No. 1,652,008 to Gercich et al (issued Dec. 6, 1927). A drier door mounting which provides some of the same functions as a range door hinge is disclosed in the U.S. Pat. No. 3,698,781 to Dunn (issued Oct. 17, 1972). The Chesser, Pollock and currently available door hinges are complex in that they contain many parts, resulting in costly manufacturing expenses, and require a multistep assembly to the range door. The Dunn mounting which is somewhat more simplified has several unconnected parts, each of which requires a separate assembly operation in order to connect it to the appliance. All of the above-described hinges would appear to be adapted to a particular size of door and would appear to require at least some different parts for counterbalancing doors of different sizes. Thus, different die and manufacturing costs and inventory costs would be required for doors of different weights or sizes.

SUMMARY OF THE INVENTION

According to the invention, a hinge for a range door and the like has a minimum number of parts which are assembled as a unit for ease of installation at the range factory with few operations. Further, the hinge according to the invention is adapted for doors of different sizes and weights by making a simple adjustment without any different parts, thereby saving tooling costs and inventory costs.

The range according to the invention comprises a frame bracket having a body portion adapted to be mounted within a housing of a range or similar appliance and a hinge flange adapted to project outwardly from the housing. A hinge arm having a door-attaching portion is adapted to be mounted to a door mounted exterior to the housing in a cam arm adapted to project into the housing and having a cam surface with a first and second end. The hinge arm is pivotably mounted to the frame bracket for pivotable movement of the door about the pivotable mounting. The hinge arm is movable between a first position at which the door will be closed and a second position at which the door will be substantially perpendicular to the housing. A cam follower arm having a cam follower element thereon is pivotably mounted to the frame bracket body portion so that the cam follower element bears against the cam surface between the first and second ends thereof and is so mounted as to provide a counterbalancing moment on the hinge arm at all positions between the first and second ends. Means bias the cam follower arm in a direction to force the cam follower element against the cam arm cam surface so as to counterbalance the weight of the door between the first and second positions.

The cam surface preferably has a means to bias the hinge door to the first position, a means to provide an equilibrium position of the hinge arm at the second position and a means to provide an intermediate equilibrium position of the hinge arm between the first and second positions. In a specific embodiment of the invention, a cam lobe provides the biasing of the hinge arm to the first position and indentations in the cam surface provide the first and intermediate equilibrium position means.

Means are provided to prevent movement of the hinge arm past the second position. In a specific embodiment of the invention, the movement-preventing means comprises a stop member struck from the frame bracket to abut the cam follower arm when the hinge arm rotates to the second position and the cam follower surface has an increasing radial distance from the hinge arm pivotable mounting at the second end.

The biasing means includes a means to adjust the force of the cam follower element against the cam surface and thereby adjust the counterbalancing force on the door. In accordance with one embodiment of the invention, the biasing means includes a tension spring connected at one end to the frame bracket and at another end to the cam follower arm. The force-adjusting means comprises a plurality of spring engagement means on the cam follower arm for retaining an end of the tension spring in a number of different positions along the cam follower arm.

BRIEF DESCRIPTION OF THE DRAWINGS

The invention will now be described with reference to the accompanying drawings in which.

DETAILED DESCRIPTION OF THE PREFERRED EMBODIMENT

Figure 1:
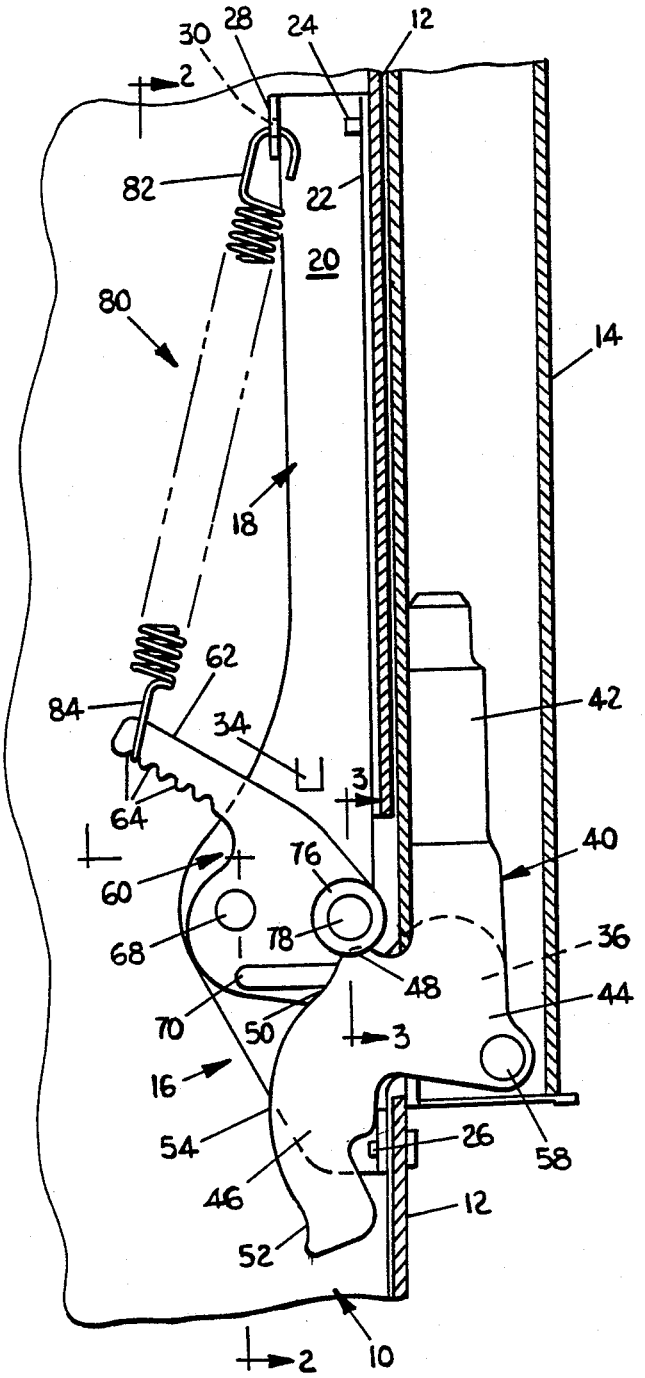
FIG. 1 is a plan view of a hinge assembly according tot he invention with the hinge assembly positioned in a range and mounting a range door in a closed position.
Figure 2:
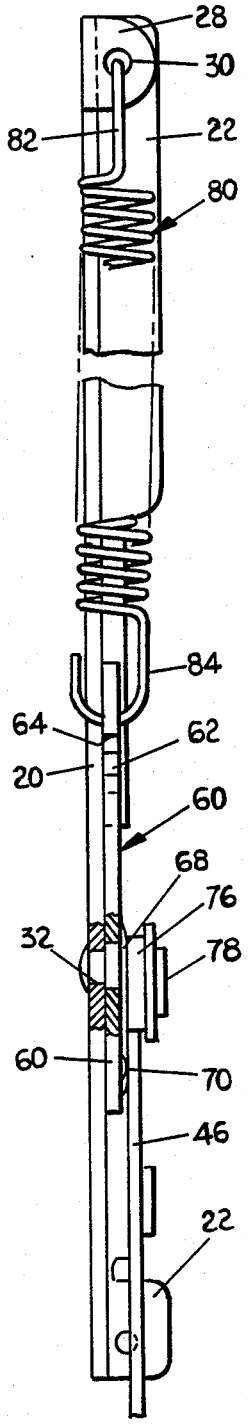
FIG. 2 is a side elevational view, partially in section, of the hinge assembly shown in FIG. 1.
Figures 3, 5:
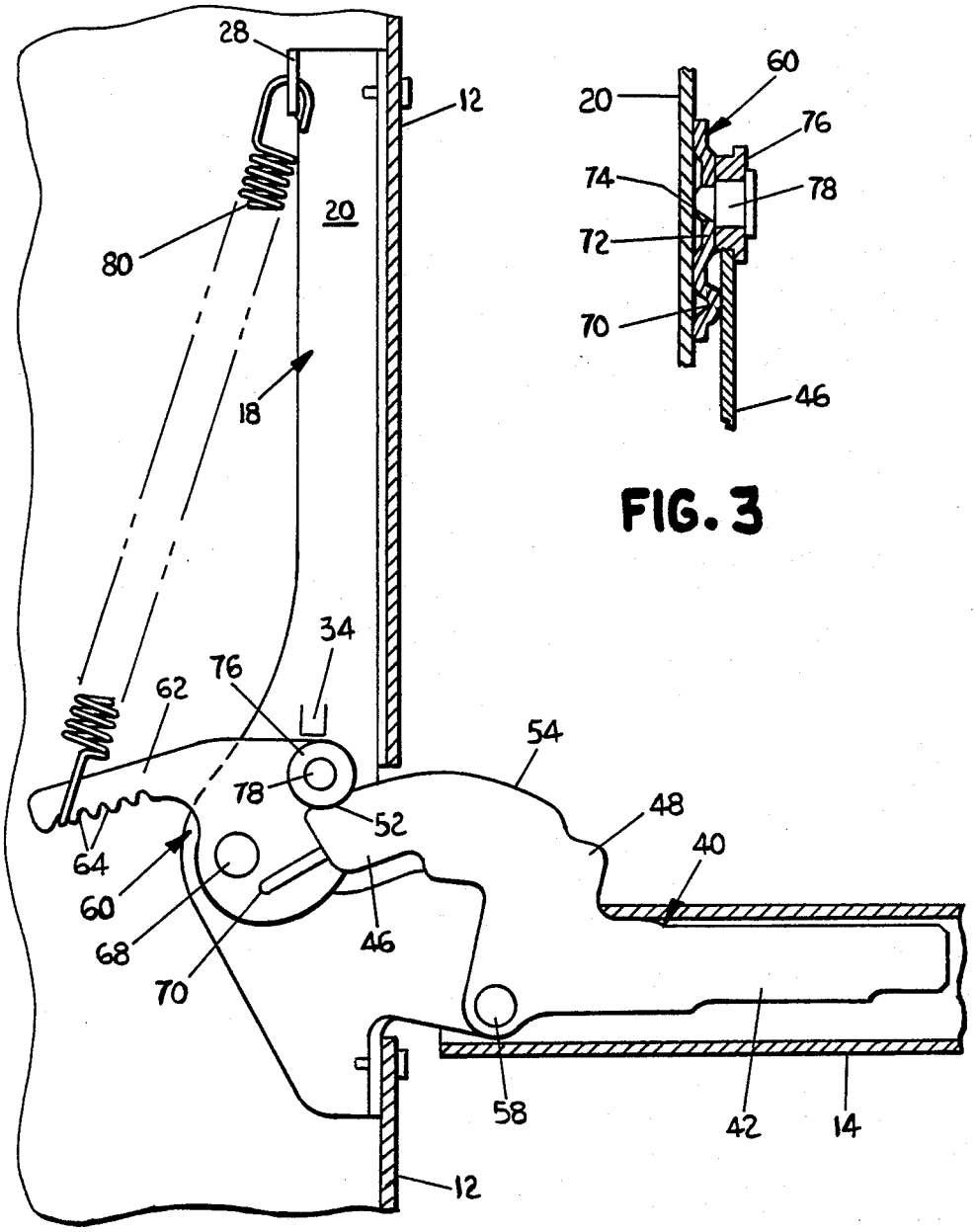
FIG. 3 is a partial sectional view taken along lines 3—3 of FIG. 1.
FIG. 5 is a view like FIG. 1, showing the range door in a fully open position.

Referring now to the drawings, and to FIGS. 1–3 in particular, there is shown a range 10 having a range mounting panel 12 and a range door 14. A hinge assembly 16 is mounted to the range through the range mounting panel 12 and to the range door to provide pivotable movement of the range door with respect to the range mounting panel 12.

The hinge assembly according to the invention comprises a hinge frame bracket 18 having a narrow elongated body portion 20, attaching flanges 22 perpendicular to the body portion 20. Tapped holes are provided in the upper and lower portions of the attaching flanges 22 and the hinge frame bracket 18 is secured to the range mounting panel 12 through machine screws 24 and 26. A spring flange 28 extends perpendicular to the body portion 20 at an upper portion thereof and has a hole 30 extending therethrough. A hole 32 (FIG. 2) is provided in the bottom portion of the body portion 20. A tab stop 34 is struck outwardly from the face of the body portion 20. A projecting hinge flange 36 extends laterally of the bottom of the body portion 20 and has a hole therethrough near the right-most end (as viewed in FIG. 1).

A hinge arm 40 has a door-attaching portion 42 which is mounted within the range door 14 through conventional means (not shown). A pivot portion 44 extends beneath the door-attaching portion 42 and a cam arm 46 extends laterally of the pivot portion 44, through an opening in the bottom of the range door 14 and through an opening in the range mounting panel 12. The cam arm 46 forms a cam surface on the outer edge thereof, the cam surface comprising a cam lobe 48 at a first end, an indentation 50, an indentation 52 at a second end and a cam-surface portion 54 between the indentations 50 and 52. A rivet 58 extends through a hole in the pivot portion 44 of the hinge arm 40 and through the hole in the projecting hinge flange 36 of the hinge frame bracket 18 to pivotably mount the hinge arm 40 to the hinge frame bracket 18.

A cam follower arm 60 has a spring-arm portion 62 with a plurality of indentations 64 on a bottom edge thereof and a hole 66. A rivet 68 extends through the hole 66 in the cam follower arm 60 and through the hole 32 in the hinge frame bracket 18 to pivotably mount the cam follower arm 60 to the hinge frame bracket 18.

The cam follower arm 60 further has an elongated embossed portion 70 which serves as a guide surface between the cam follower arm 60 and the cam arm 46 of the hinge arm 40. The cam follower arm 60 also has a raised portion 72 with a hole 74 extending therethrough. A cam follower element in the form of a roller 76 is secured to the cam follower arm 60 at the raised portion 72 through a rivet 78. The cam follower roller 76 is positioned to roll on and bear against the cam surface of the cam arm 46.

An elongated tension spring 80 has a hook end 82 which extends through the hole 30 in the spring flange 28 and has a hook 84 at the other end which engages one of the indentations 64 on the spring-arm portion 62 of the cam follower arm 60. Thus, the spring 80 biases the cam follower arm 60 in a clockwise direction as viewed in FIG. 1 to thereby resiliently urge the cam follower roller 76 against the cam surface of the cam arm 46. The force of the roller 76 against the cam surface of the cam arm 46 produces a moment in a counterclockwise direction on the hinge arm 40 about the rivet 58. The magnitude of the force created by spring 80 on the cam follower arm 60 through the cam follower roller 76 can be changed by moving the hook 84 of spring 80 to a different indentation 64 along the cam follower arm 60. Movement of the hook to the right as viewed in FIG. 1 will decrease the force on the cam arm 46 and movement of the hook to the left will increase the force on cam arm 46. Thus, the hinge is adaptable to range doors of different weight without any interchange of parts.

In operation, the hinge assembly is in the position illustrated in FIG. 1 when the range door is closed. In this position, the cam follower roller 76 exerts a downward force on the lobe 48 to produce a moment in a counterclockwise direction on the hinge arm 40 about the rivet 58. Thus, the range door 14 is resiliently biased into engagement with the upper portion of the range mounting panel 12 by the force on the cam lobe 48 exerted by the cam follower roller 76.

Figure 4:
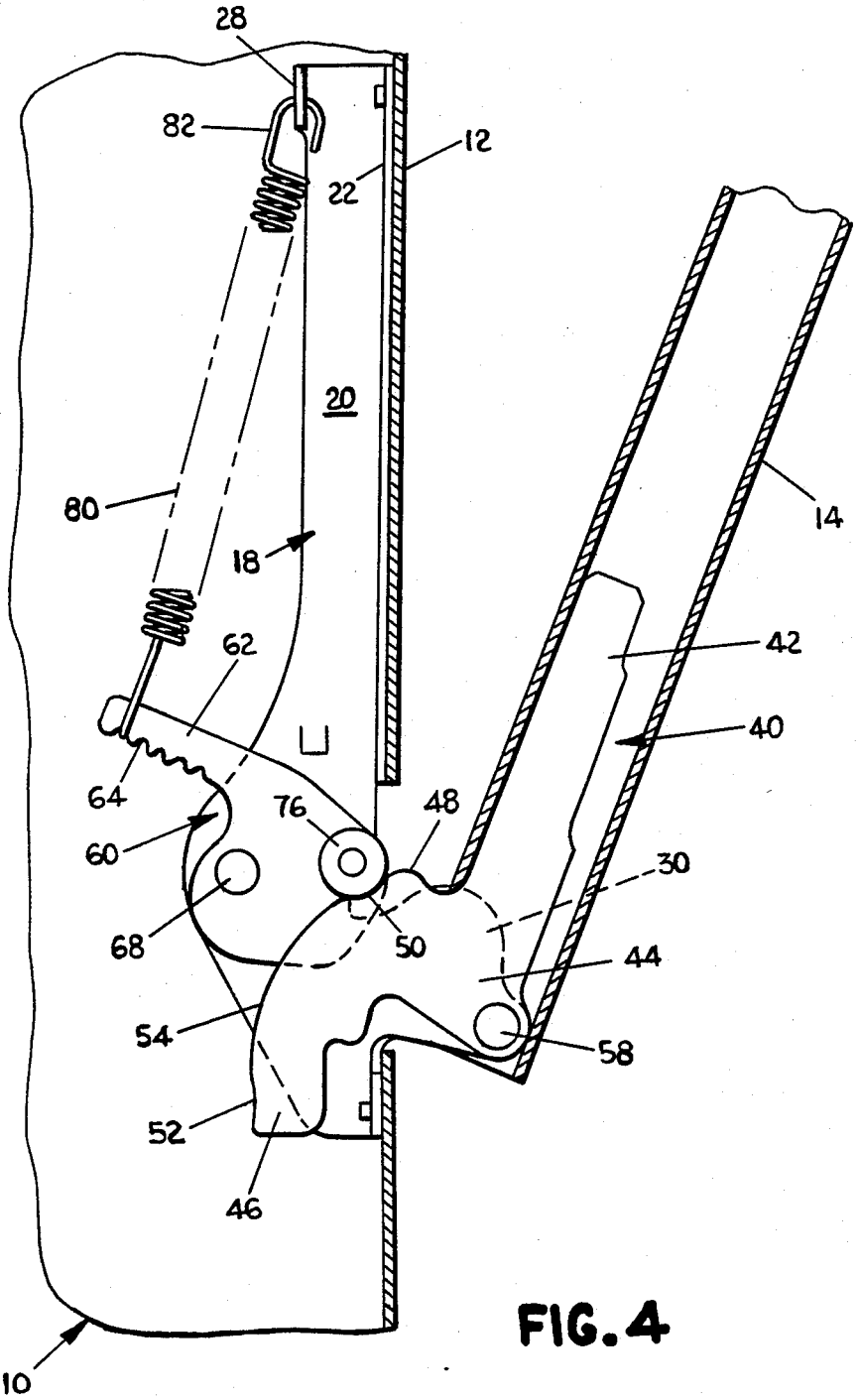
FIG. 4 is a view like FIG. 1, showing the range door in an ajar position.

When the range door is opened to the ajar position, the hinge will assume the position illustrated in FIG. 4. In this position, the hinge arm 40 has rotated approximately 30° from its closed position illustrated in FIG. 1. The cam roller 76 has moved into the indentation 50 in the cam arm 46. The weight of the range door 14 in this position counterbalances the moment on the hinge arm 40 about the rivet 58 so that the position illustrated in FIG. 4 is an equilibrium position. If the range door 14 is moved slightly in a counterclockwise direction as viewed in FIG. 4, the cam follower roller 76 will move up along the lobe 48. Release of the door 14 will cause the door to move back to the ajar position illustrated in FIG. 4.

Conversely, moving the door slightly in a clockwise direction will also result in the range door 14 moving back to the ajar equilibrium position illustrated in FIG. 4 due to the indentation 50. Thus, the indentation 50 provides an equilibrium position means of the door in an ajar position.

As the door is rotated about the rivet 58, the moment created by the weight of the door about the rivet 58 increases. At the same time, the cam-surface portion 54, which has an increasing radius from the rivet 58, forces the cam follower arm to rotate in a counterclockwise direction as illustrated in FIGS. 4 and 5 about the rivet 68, thereby increasing the length and tension of the spring 80. When the door is in the fully open position as illustrated in FIG. 5, the cam follower roller 76 will be positioned within the indentation 52. During the rotation of the door about the rivet 58, the increasing weight of the door will be counterbalanced by the increasing tension in the spring 80. When the door reaches its fully open position, as illustrated in FIG. 5, the combination of the indentation 52, the tension in spring 80 and the weight of door 14 provides a balance so that the door reaches an equilibrium position in the fully open position illustrated in FIG. 5. Thus, the indentation 52 provides an equilibrium position means for the door in a fully open position. When the door is in this position, the cam follower arm 60 rotates to the point where the upper surface thereof abuts the tab stop 34 to prevent further counterclockwise rotation of the cam follower arm 60 with respect to the hinge frame bracket 18. It is noted that the radius of the cam arm from the rivet 58 increases at the second end so that movement of the cam arm 46 in a clockwise direction past indentation 52 tends to move the cam follower arm in a counterclockwise direction against the tab stop 34. Thus, the door cannot be opened any further than the position illustrated in FIG. 5. Movement of the door slightly in a counterclockwise direction about the rivet 58 will result in a slight unbalanced moment on the hinge arm 40 which tends to move the door in a counterclockwise direction until it reaches the equilibrium position illustrated in FIG. 4.

The force applied to the cam arm 46 by the cam follower roller 76 will be directed along a line which is perpendicular to the line between the rivet 68 and the contact between the cam arm 46 and the cam roller 76. Thus, in the initial position illustrated in FIG. 1, the direction of the force vector on the cam arm 46 will be downward at about the 7 o'clock position. Thus, there is a substantial distance between the pivot point of the hinge arm 40 and the force vector, thereby creating a substantial counterclockwise moment about the rivet 58. As the cam follower arm 60 rotates about the rivet 78, the force vector will rotate in a counterclockwise direction until the cam follower arm 60 reaches the position illustrated in FIG. 5. At this point, the force vector will still lie to the left of the rivet 58 so there still will be a counterclockwise moment on the hinge arm 40. Although the distance between the rivet 58 and the force vector has decreased, the tension in the spring will increase due to the rotation of the cam follower arm 60 in a counterclockwise direction. Thus, the magnitude of the force will increase although the moment applied by the cam follower arm 60 may decrease somewhat.

Thus, the invention provides a simple and inexpensive, yet very effective, hinge for a range door which provides three stable equilibrium positions. The invention is easily adaptable to range doors of different size and/or weight by simply selecting a different position of the hook 84 of spring 80 in the indentation 64 of cam arm 60.

Whereas the invention has been described with respect to a hinge which is mounted on a range to control the movement on a range door, the hinge is applicable to other types of hinge structures where several equilibrium positions are required.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. A self-contained hinge assembly for a range door comprising:

a frame bracket having a body portion adapted to be mounted within a housing of a range or similar appliance and a hinge flange having an outer portion adapted to project outwardly from the housing;

a one-piece rigid hinge arm having a door-attaching portion adapted to be rigidly mounted to a door mounted exterior to the housing and a cam arm adapted to project into said housing, the cam arm having a cam surface with a first and second end;

means pivotably mounting the hinge arm to the outer portion of the frame bracket hinge flange for pivotable movement of the door about the pivotable mounting means, the hinge arm being movable between a first position at which the door will be closed and a second position at which the door will be substantially perpendicular to the housing;

a cam follower arm having a cam follower element thereon;

means for pivotably mounting the cam follower arm to the frame bracket body portion so that the cam follower arm bears against the cam surface between the first and second ends thereof and so as to produce a counterbalancing moment on the hinge arm at all positions between the first and second ends; and means acting between the frame bracket and the cam follower arm for biasing said cam follower arm in a direction to force the cam follower element against the cam follower cam surface so as to counterbalance the weight of the door between the first and second positions.

2. A hinge assembly according to claim 1 wherein the cam surface has means to bias the hinge arm to the first position; means to provide a first equilibrium position of the hinge arm at the second position; and means to provide an intermediate equilibrium position of the hinge arm between the first and second positions.

3. A hinge assembly according to claim 2 wherein the biasing means comprises a lobe on the cam surface.

4. A hinge assembly according to claim 3 wherein the first and intermediate equilibrium position means comprise indentations in the cam surface.

5. A hinge assembly according to claim 2 and further comprising means to prevent movement of the hinge arm past the second position.

6. A hinge assembly according to claim 1 and further comprising means to limit the movement of the hinge arm past the second position.

7. A hinge assembly according to claim 6 wherein the movement-limiting means comprises a stop member struck from the bracket to abut the cam follower arm when the hinge arm rotates to the second position; and said cam surface has an increasing radial distance from the hinge arm pivotably mounting means at the second end.

8. A hinge assembly according to claim 7 wherein the biasing means includes means to adjust the force of the cam follower element against the cam surface and thereby adjust the counterbalancing force on the door.

9. A hinge assembly according to claim 8 wherein the biasing means includes a tension spring connected at one end to the frame bracket and at another end to the cam follower arm, and the force-adjusting means comprises a plurality of spring engagement means on the cam follower arm for retaining an end of the tension spring in a number of different positions on the cam follower arm.

10. A hinge assembly according to claim 9 wherein the cam surface has means to bias the hinge arm to the first position; means to provide a first equilibrium position of the hinge arm at the second position of the hinge; and means to provide an intermediate equilibrium position of the hinge arm between the first and second positions thereof.

11. A hinge assembly according to claim 6 wherein the biasing means includes means to adjust the force of the cam follower element against the cam surface and thereby adjust the counterbalancing force on the door.

12. The hinge assembly of claim 11 wherein the biasing means includes a tension spring connected at one end to the frame bracket and at another end to the cam follower arm, and the force-adjusting means comprises a plurality of spring engagement means on the cam follower arm for retaining an end of the tension spring in a number of different positions on the cam follower arm.

13. A hinge assembly according to claim 11 wherein the cam surface has means to bias the hinge arm to the first position; means to provide a first equilibrium position of the hinge arm at the second position of the hinge arm; and means to provide an intermediate equilibrium position of the hinge arm between the first and second positions thereof.

14. A hinge assembly according to claim 1 wherein the biasing means includes means to adjust the force of the cam follower element against the cam surface and thereby adjust the counterbalancing force on the door.

15. A hinge assembly according to claim 14 wherein the biasing means includes a tension spring connected at one end to the frame bracket and at another end to the cam follower arm, and the force-adjusting means comprises a plurality of spring engagement means on the cam follower arm for retaining an end of the tension spring in a number of different adjusted positions on the cam follower arm.

* * * * *